US006467992B1

(12) United States Patent
Dietrich

(10) Patent No.: US 6,467,992 B1
(45) Date of Patent: Oct. 22, 2002

(54) ATTACHMENT FOR A FINISHER

(75) Inventor: Willi Dietrich, Bad Hersfeld (DE)

(73) Assignee: Hermann Kirchner GmbH & Co. KG, Bad Hersfeld (DE)

( * ) Notice: Subject to any disclaimer, the term of this patent is extended or adjusted under 35 U.S.C. 154(b) by 0 days.

(21) Appl. No.: 09/622,775

(22) PCT Filed: Feb. 20, 1999

(86) PCT No.: PCT/DE99/00479

§ 371 (c)(1),
(2), (4) Date: Aug. 23, 2000

(87) PCT Pub. No.: WO99/42664

PCT Pub. Date: Aug. 26, 1999

(30) Foreign Application Priority Data

Feb. 24, 1998 (DE) ..... 298 03 077 U

(51) Int. Cl.[7] ..... E01C 19/12; E01C 19/22
(52) U.S. Cl. ..... 404/101; 404/108; 404/118
(58) Field of Search ..... 37/142.5; 172/810, 172/811, 817; 404/74, 77, 84.1, 84.5, 101, 102, 108, 118

(56) References Cited

U.S. PATENT DOCUMENTS

| | | | | | |
|---|---|---|---|---|---|
| 2,891,335 | A | * | 6/1959 | Linneman | |
| 3,016,635 | A | * | 1/1962 | Aston | |
| 3,967,913 | A | * | 7/1976 | Gabriel, Jr. | 404/109 |
| 3,992,124 | A | * | 11/1976 | Schrader | 404/118 |
| 4,272,212 | A | * | 6/1981 | Bauer, Jr. et al. | 404/72 |
| 4,317,642 | A | * | 3/1982 | Wirtgen | 404/72 |
| 4,678,364 | A | * | 7/1987 | Charonnat et al. | 404/105 |
| 4,702,642 | A | * | 10/1987 | Musil | 404/118 |
| 4,765,772 | A | * | 8/1988 | Benedetti et al. | 404/77 |
| 4,896,489 | A | * | 1/1990 | Wykuis | 56/15.9 |
| 5,000,615 | A | * | 3/1991 | Murray | 404/75 |
| 5,009,546 | A | * | 4/1991 | Domenighetti et al. | 404/110 |
| 5,026,206 | A | * | 6/1991 | O'Connor | 404/77 |
| 5,251,999 | A | * | 10/1993 | McCracken | 404/109 |
| 5,735,634 | A | * | 4/1998 | Ulrich et al. | 404/102 |
| 5,741,085 | A | * | 4/1998 | Wirtgen | 404/75 |
| 5,921,708 | A | * | 7/1999 | Grundl et al. | 404/84.1 |
| 5,924,819 | A | * | 7/1999 | Breidenbach | 404/96 |
| 6,027,282 | A | * | 2/2000 | Horn | 404/75 |

FOREIGN PATENT DOCUMENTS

| | | |
|---|---|---|
| DE | 296 03 717 | 4/1996 |
| DE | 297 12 038 | 1/1998 |
| EP | 0 730 694 | 4/1997 |
| FR | 2 697 036 | 4/1994 |
| WO | WO95/14820 | 6/1995 |

* cited by examiner

*Primary Examiner*—Thomas B. Will
*Assistant Examiner*—Raymond W Addie
(74) *Attorney, Agent, or Firm*—Collard & Roe, P.C.

(57) ABSTRACT

An attachment device for laying two surface layers which may also consist of different materials in a road way. The device should be economical to produce and suitable for laying multilayer road surfaces or for simply laying a conventional single layer surface. To this end, the inventive attachment contains elements for simultaneously laying two layers, hot on hot. The elements are mounted on a frame to be detachably connected to the finisher, the frame having fixing points for detachably connecting the attachment and the finisher and the attachment and the driver's cab.

5 Claims, 9 Drawing Sheets

ATTACHMENT FOR A FINISHER

The invention relates to an attachment for a finisher for laying and compressing road pavements, the finisher having a chassis with a driving aggregate, a material supply container, a driver's cabin, a distributing device, a transporting device as well as a tamping beam.

The supplementary attachment can be mounted on commercially available finishers and preferably serves for laying two-layer road asphalt pavements. However, it is possible also with said attachment to lay concrete layers or combined concrete and asphalt pavements, as well as road pavements of any type.

It is known in the prior art to lay road pavements on road constructions with the help of finishers. Currently dominating for this purpose is the asphalt road construction method because said construction material offers a number of advantages. In order to adapt the asphalt type of road surfacing in a superior way to the stresses imposed by heavy traffic, it is deemed desirable to increase the degree of compression and to reduce the thickness of the top layers. Compressed asphalt is increasingly used in order to achieve effective sealing of the top layer as well as to minimize the aging of the binding agents and to avoid tracking grooves, surface damages, cracks and chipping. The road paving is laid, for example with two finishers, one running directly after the other.

FR-A 2,697,036 describes a finisher that produces a main pavement which is suitable for a road with motor vehicle traffic, for example, and lays next to it a secondary pavement that is suitable for bicycle traffic, for example. The laying of hot-on-hot is not possible with this finisher over the entire laying width because rolled asphalt is a very viscous mass that can be distributed over the base or transported only by means of screw conveyors or other devices with high expenditure of force.

Furthermore, a finisher is known from EP 0 730 694 B1 that permits laying and compacting a two-layer top asphalt coat with only one fishing machine. A second conveying and distributing system is mounted on said finisher on an enlarged base frame.

A drawback of said arrangement is that for laying two asphalt layers, a special finisher is required that can be employed only for the special task of laying a two-layer asphalt structure, and which, furthermore, requires very high manufacturing costs.

It is the object of the invention to provide a device, in combination with a conventional finisher, which permits the laying of two layers of pavement in an economic manner, even if consisting of different materials, and which can be manufactured at favorable costs. In addition, a simple conversion of the finisher makes it possible to be employed both for laying multi-layered road pavements and for the conventional laying of a pavement comprising only one layer.

The problem is solved according to the invention with the characterizing features of claims 1.

Advantageous further developments of the device as defined by the invention are specified in the dependent claims.

A finisher equipped with the attachment as defined by the invention permits the laying of a two-layer asphalt pavement or also the laying of top coats consisting of other materials with one machine that can be adapted to the given task by only refitting an existing finisher by mounting on such an existing finishing machine, or removing from it, only one attachment. Said attachment can be easily removed again, so that the user requires only one machine that can be employed both for the conventional laying of only one paving layer and for laying a two-layer pavement. Furthermore, the machine can be manufactured at substantially more favorable cost than a separate double-finisher.

A finisher equipped with the attachment as defined by the invention has two separate tamping beams, whereby the first tamping beam is designed as a standard or highly compressing beam, and the second tamping beam can be designed both as a standard tamping beam and a highly compressing beam. The first tamping beam serves as the laying and pre-compressing beam and permits extremely high pre-compression, for which reason a substantially higher flatness of the two-layer pavement is achieved as compared to pavements laid according to known methods. The planeness so achieved, in conjunction with high pre-compression, makes it possible to reduce after-compression, which may still be required, to a minimum.

An important advantage of the attachment as defined by the invention lies in that series-produced components usable for finishers of the usual type can be used for the components "pre-distributing system" and "compression beam" of the attachment.

Owing to the arrangement of two tamping beams as defined by the invention it is possible, furthermore, to produce separate profiles for the two layers. It is possible, for example, to incorporate rain water gutters. Another important advantage is that a finisher of the conventional is obtained in a simple way by simply removing the attachment, whose functions remain fully preserved and which can operate without an additional transfer device.

It is possible to provide the control of the layer thickness, the so-called leveling coupled with the first beam, or independently thereof with a separately operating control for the second beam. Commercially available rigid beams or also extendable beams can be employed as laying beams.

The invention is explained in greater detail in the following with the help of an exemplified embodiment. The associated drawings show the following:

FIG. 1 shows a commercially available finisher in the starting condition,

FIG. 2 shows the finisher after the material supply container and the driver's cabin have been removed, FIG. 3 shows an attachment as defined by the invention, FIG. 4 shows an enlarge material supply container, FIG. 5 shows the finisher with the attachment attached to it and with the enlarged material supply container for the material for the base layer, FIG. 6 shows the finisher with the attachment attached to it and with the part folded up, FIG. 7 shows an embodiment for a finisher equipped with the attachment as defined by the invention, and a side view of a transfer device additionally mounted on the finisher, FIG. 8 shows the associated top view, FIG. 9 is a side view of an embodiment with a material supply trough arranged on the attachment both in front and in the back.

FIG. 1 shows a commercially available finisher on which an attachment as defined by the invention is to be mounted.

For refitting the finisher to obtain a laying machine with which a two-layer asphalt paving can be laid, the material supply container and the driver's cabin are removed first. FIG. 2 shows the condition after said components have been removed. The chassis of the finisher with the driving aggregate, the distributing and conveying devices as well as the tamping beam for the base material are present on the remaining basic machine.

The attachment and the material supply container for the base material are subsequently mounted on the basic machine. For this purpose it is necessary only to push said devices onto the basic machine from the side and to secure them there.

FIG. 3 explains an embodiment of the attachment as defined by the invention.

Figure 6:
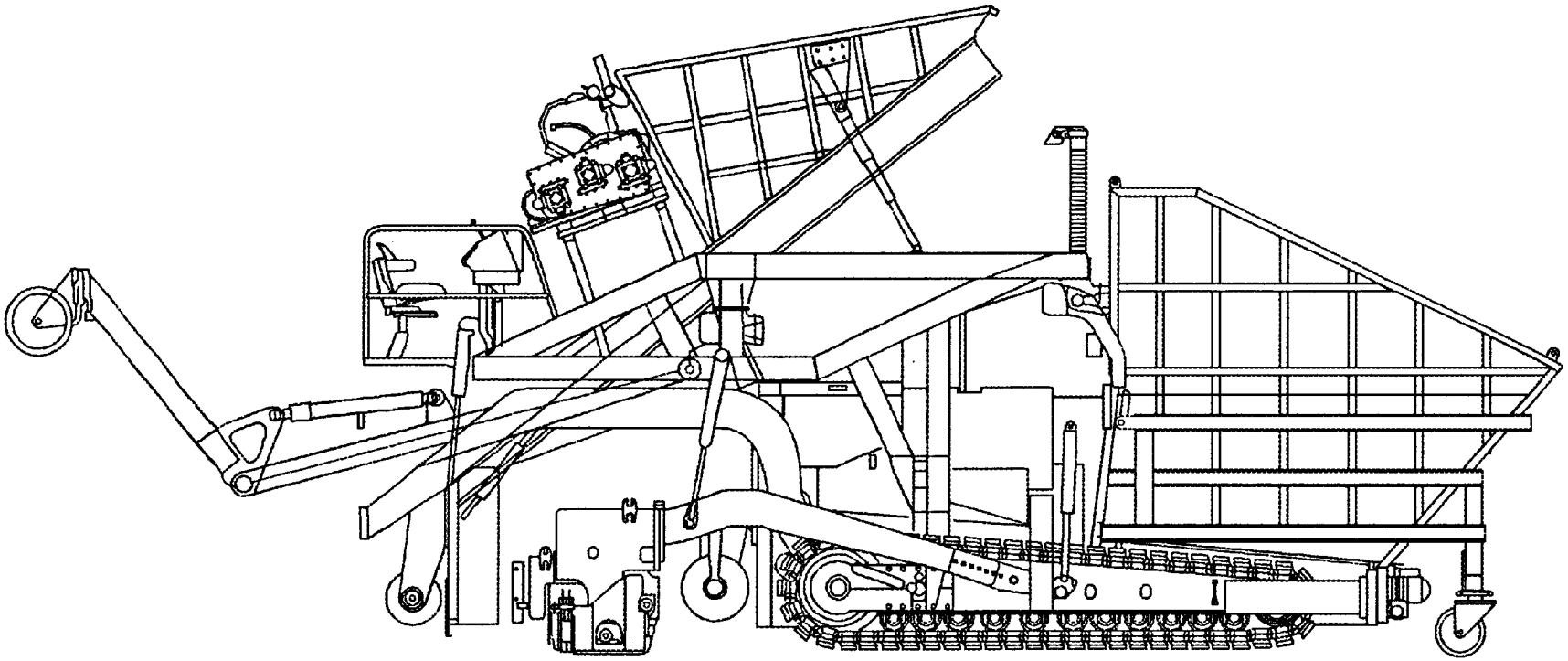

FIG. 6 shows that part of the mounted attachment can be folded up. This is advantageous in order to be able to carry out maintenance work on the basic machine without having to remove the attachment. In order to make it possible to swivel the attachment, the frame consists of pivot-mounted supports that are connected in bearing sites with the stationary part of the frame, and which can be moved with the help of hydraulic cylinders. Furthermore, swiveling arms with support wheels are mounted on the frame. Said devices make it easier to move the attachment against the side of the machine for mounting it on the basic machine, and, furthermore, contribute to increasing the stability of the overall arrangement.

Figure 7:
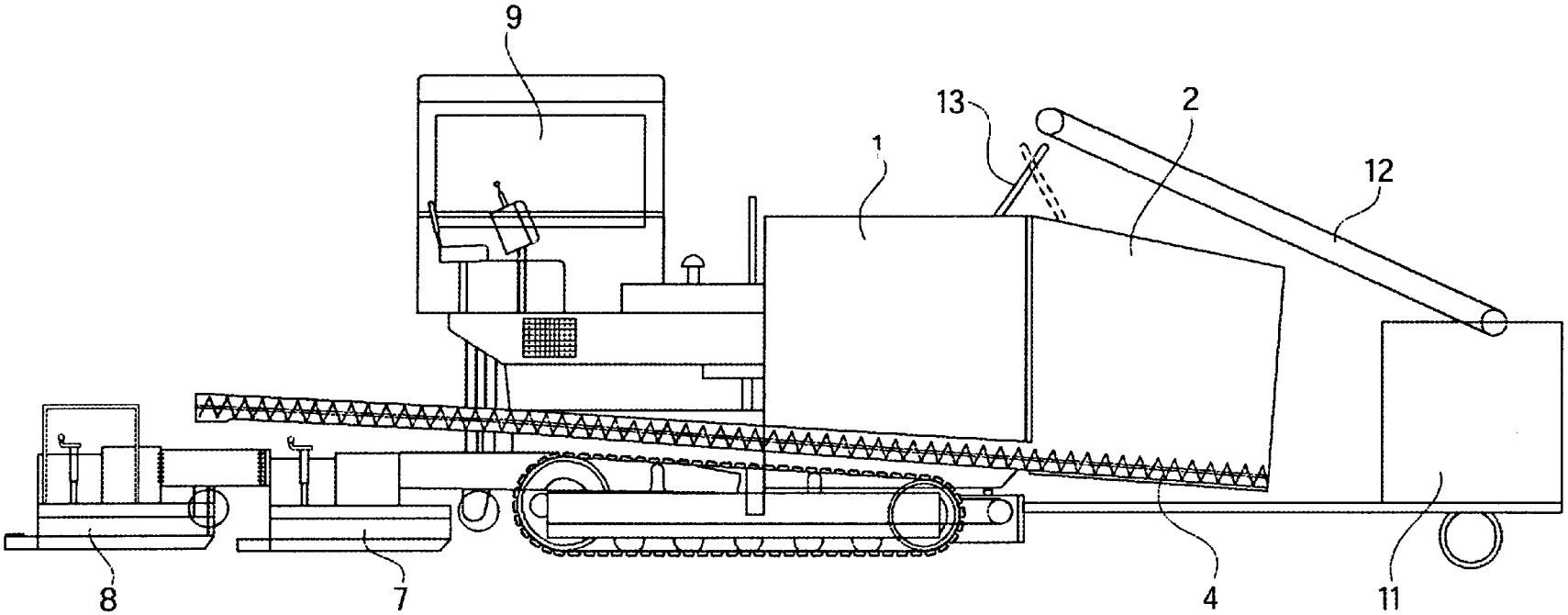
Figure 8:
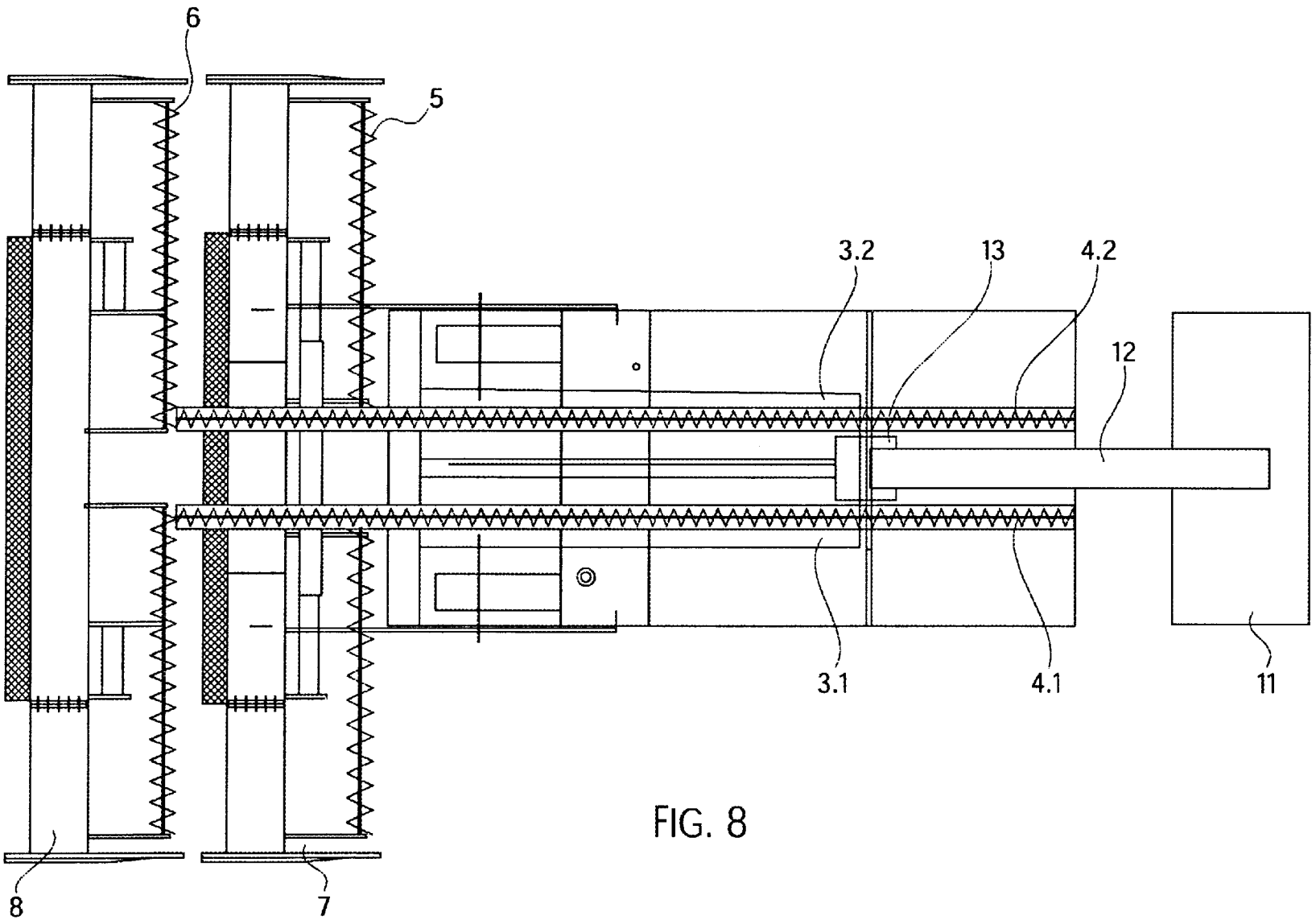

With the finisher shown in FIGS. 7 and 8, both the material supply container 1 for the base layer and the material supply container 2 for the top layer are located on the front side of the finisher. The finisher consists of a commercially available road finishing machine in connection with which a material layer, in the shown case the base layer is transported from the material supply container 1 via the conveyor belts for the system 1 to the pre-compressing beam 7, whereby the material is first distributed over via the distributing screw 5.

For mounting the attachment on a commercially available finisher it is necessary only to removed the driver's cabin from said finisher, to push the attachment onto the chassis of the finisher, and to secure it on the driver's cabin. Screw fasteners are preferably used for securing the attachment. In the exemplified embodiment shown, said screw fasteners are installed on fork-like fastening elements and in corresponding openings of the subassemblies to be connected.

The material for the top layer is stored in and transported with the attachment as defined by the invention, and it is laid with said attachment. For this purpose, an additional supply container 2 for the material of the top layer is arranged on the frame of the attachment in such a way that in the mounted condition, it is located in front of the supply container 1 of the finisher. The additional supply container 2 is heated, for which purpose it is possible to use the exhaust gases of the driving engines or additional heating devices that are operated with gas or electrically. From the supply container 2, the material to be laid is transported via the conveying system 4, which in the present case is realized in the form of screws, to the rearward compression beam 8 for the top layer. The additional compression beam 8 can be mounted directly on the laying beam 7, which is already present on the finisher, or it can be mounted on the finisher separately.

The second beam can be controlled by means of a leveling device that is already available on the finishing machine, or by an additional second leveling device.

The second beam can be mounted both rigidly on the first beam, with vertical adjustment, or it can be connected with the first beam in an articulated manner. It is usefully secured on the leveling pole. Furthermore, it is possible to arrange the second beam articulated on the undercarriage of the tractor.

Figure 1:
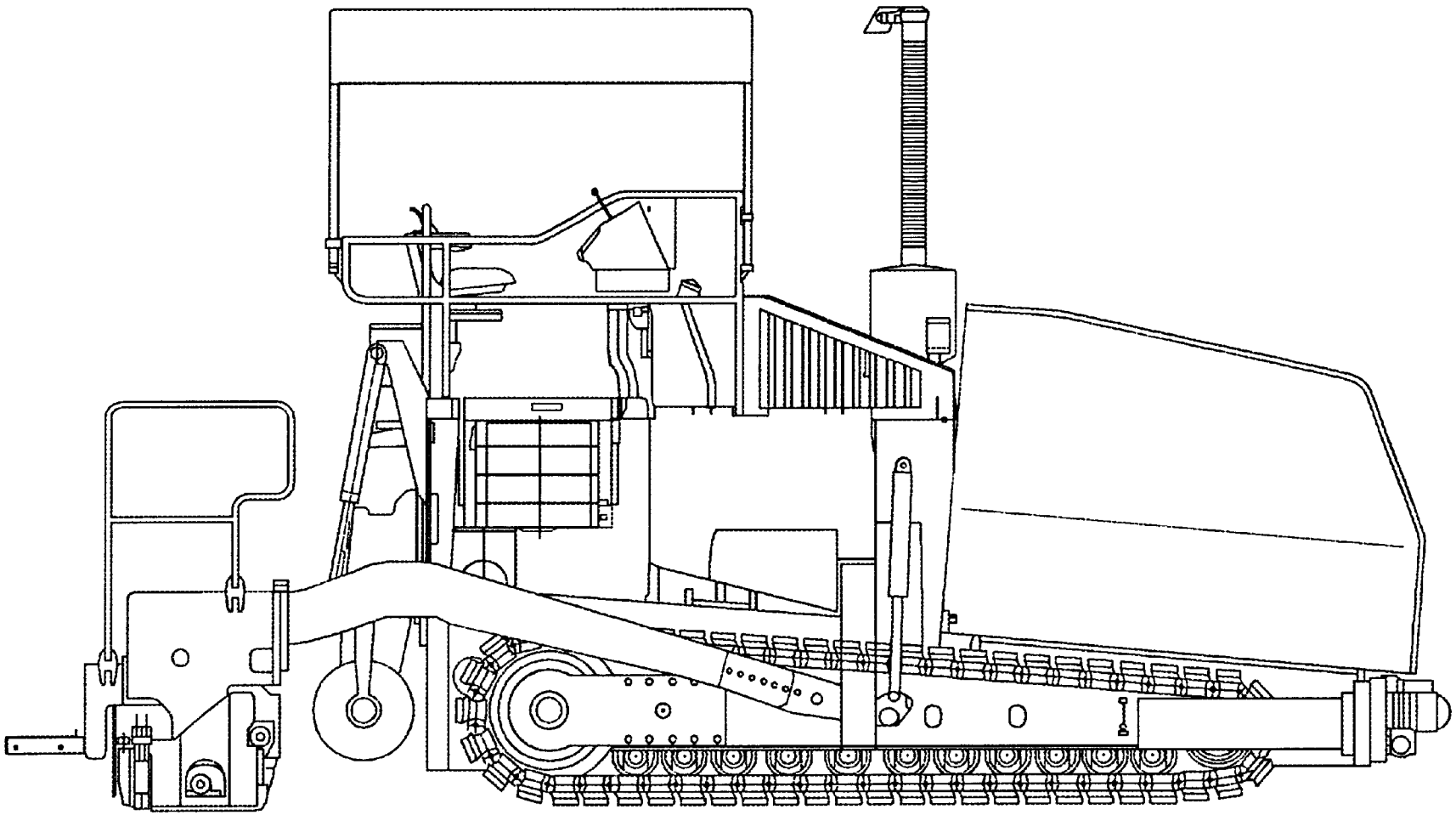
Figure 2:
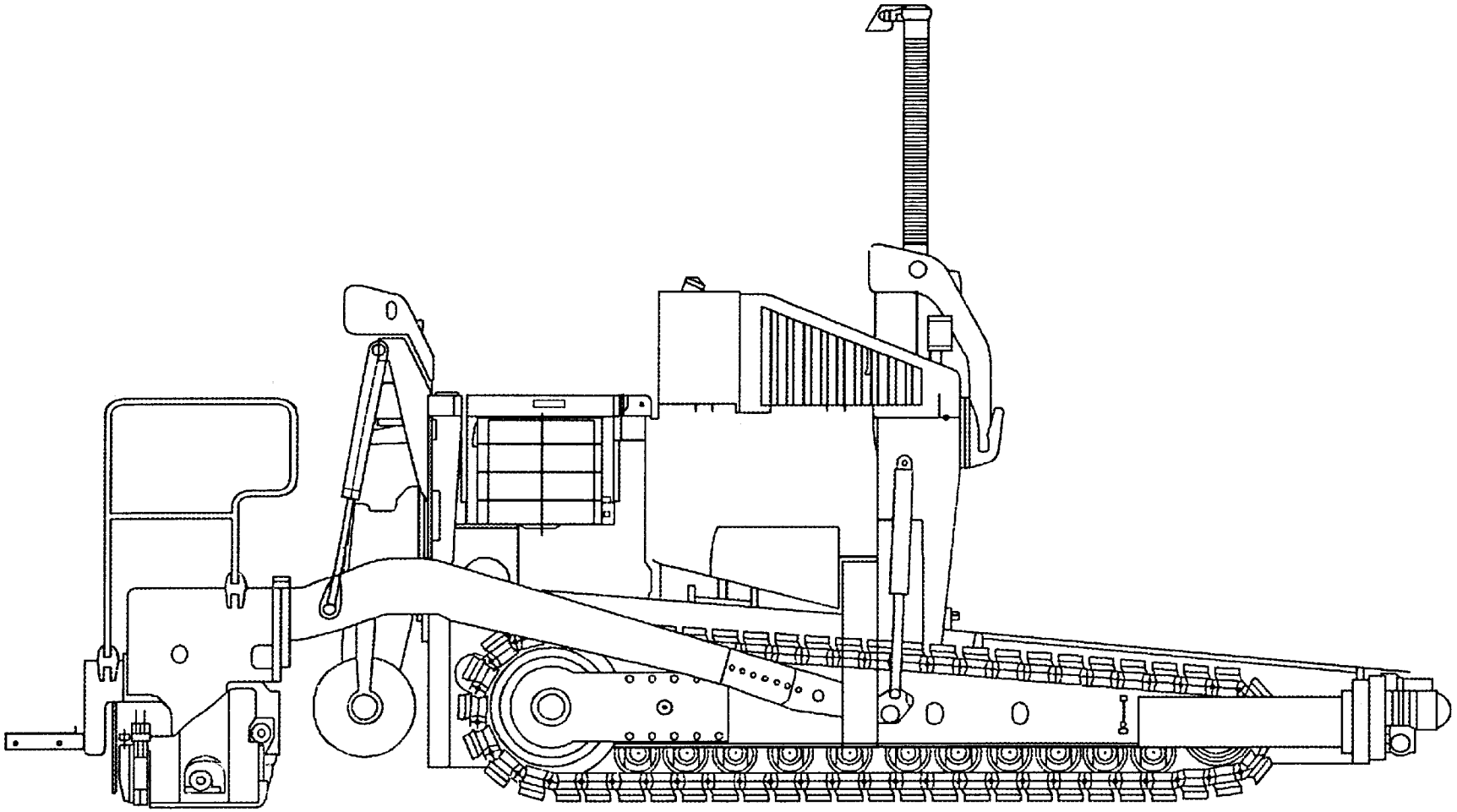
Figure 3:
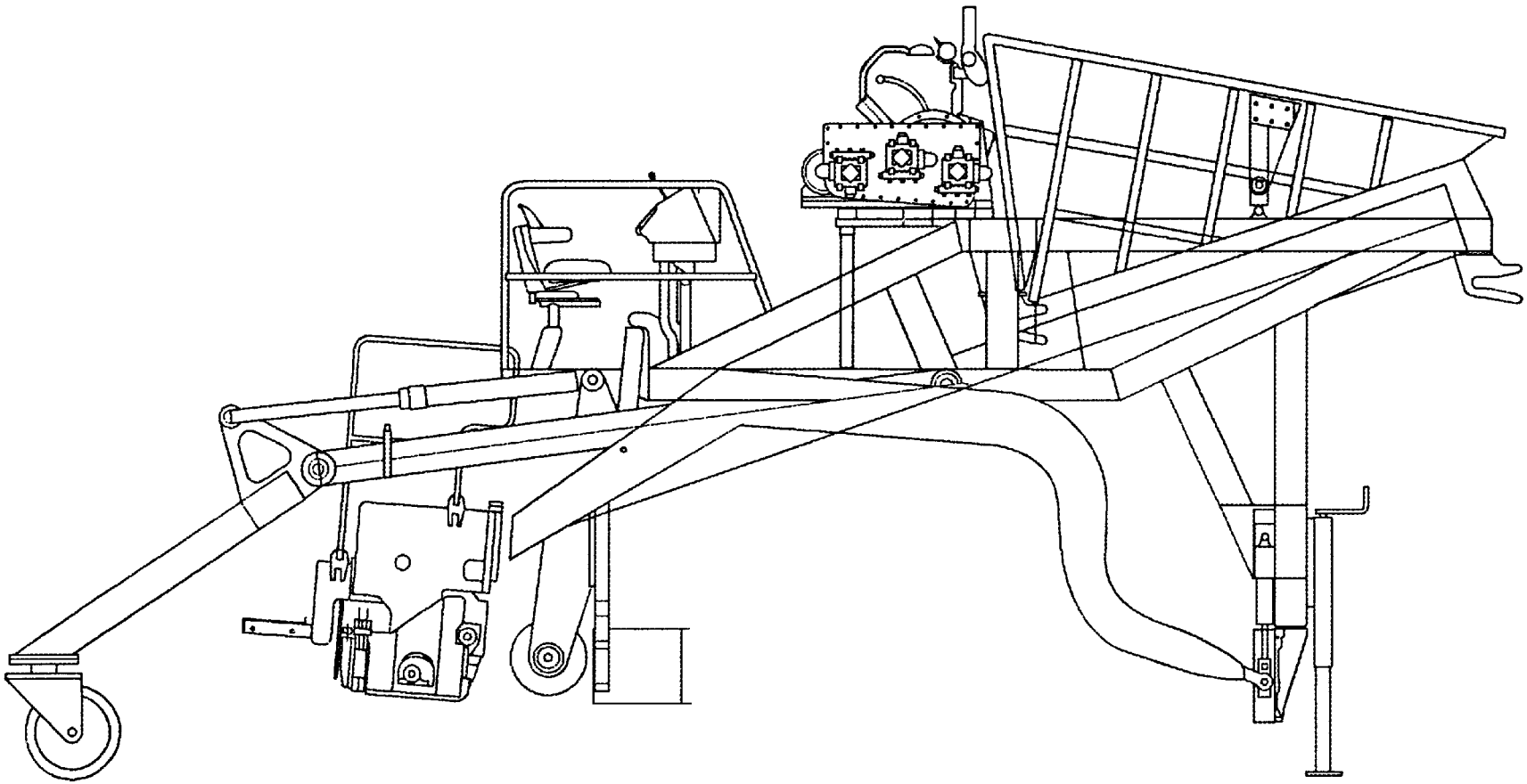
Figure 4:
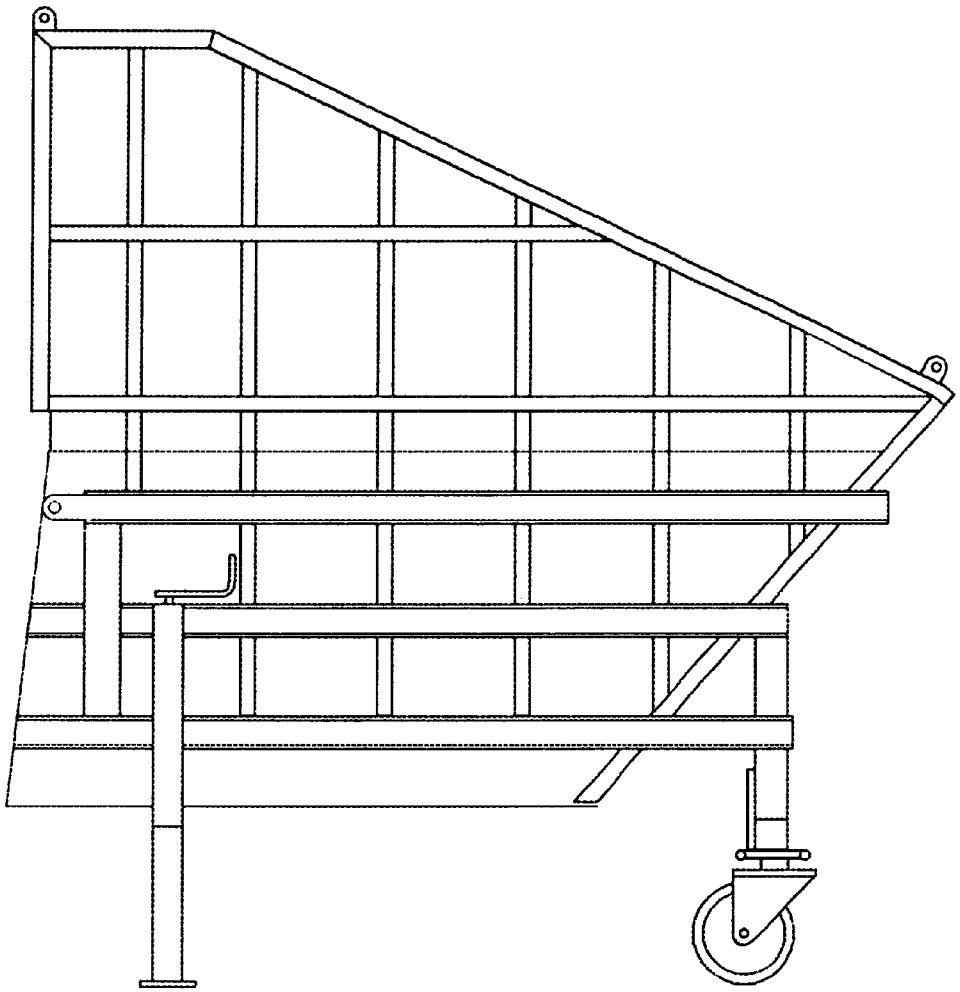
FIG. 4 shows an enlarged material supply container that can be mounted instead of the original material reservoir.
Figure 5:
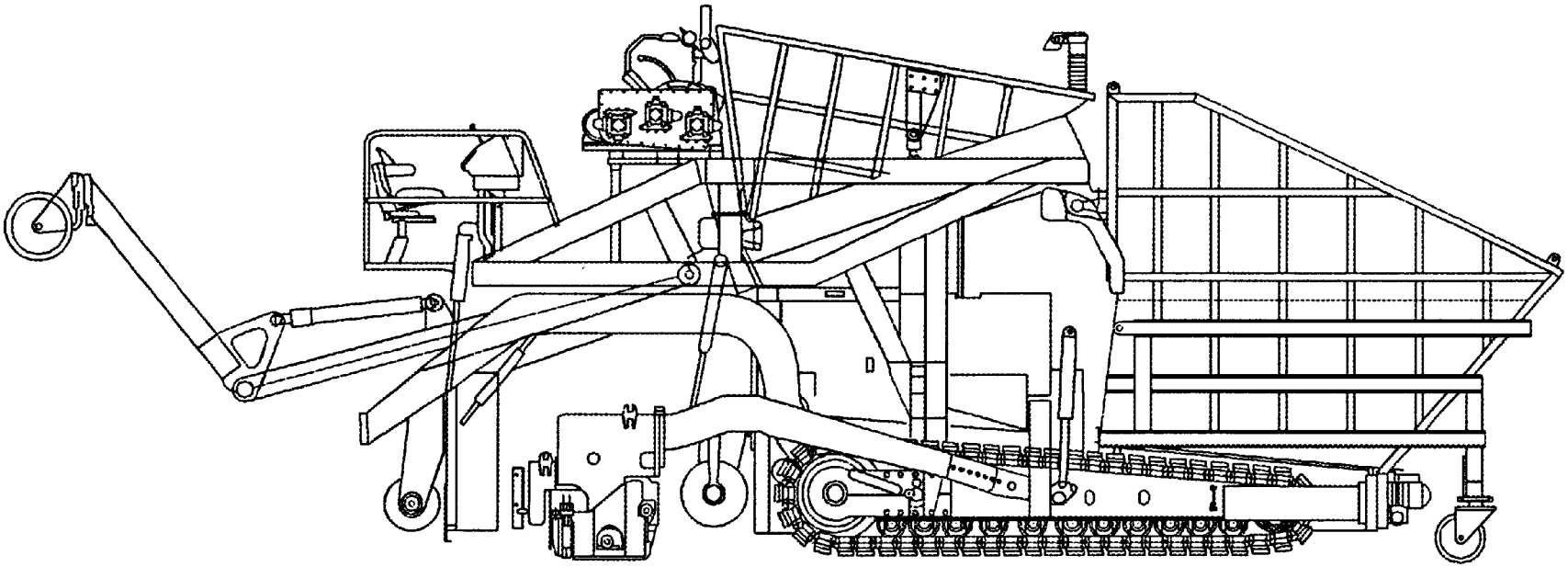
FIG. 5 shows the refitted finisher with the attachment attached to it, and with the enlarged material supply container for the material of the base.
Figure 9:
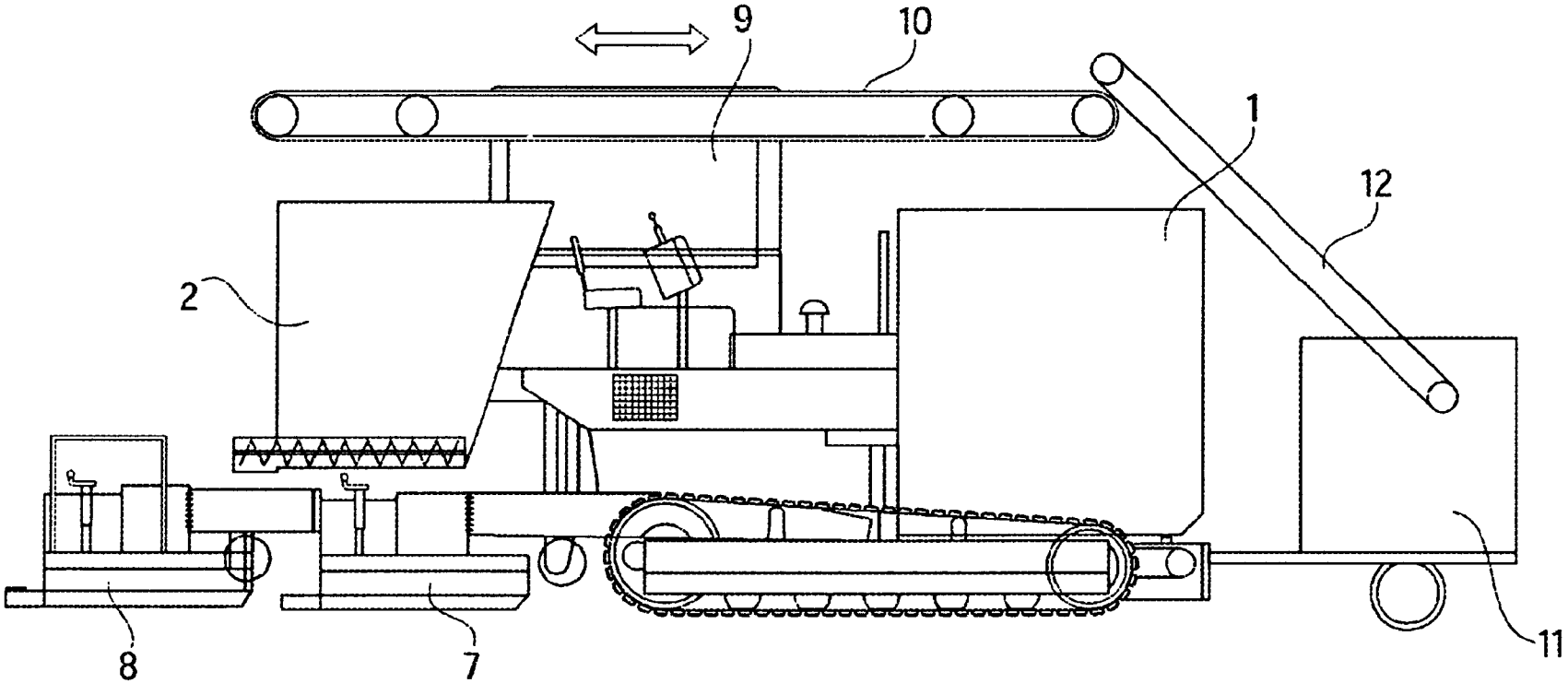

FIG. 9 explains an exemplified embodiment for a design where the material supply container 2 is arranged behind the driver's cabin 9. It is basically possible also to mount said supply reservoir above the driver's cabin 9, or to mount it on the side of the latter. In the embodiment shown in FIG. 3, a rotatable or displaceable conveyor element is mounted above the supply container 2 for an additional conveyor system, which is realized in the form of a conveyor belt 10 in the present case. With said additional conveyor belt 10, the material can be transported from the front side of the finisher—where it can be loaded in a sim0le way—to the supply container 2. In order to permit unobstructed filling of the supply container 1, the additional conveyor belt 10 is arranged in such a way that it can be rotated or displaced in the driving direction, so it can be pushed rearward for filling the container 1, whereas it is located in the front position for filling the container 2.

It is possible also to mount a supply container on a separately driving device outside of the finisher. Said device can be pushed by the finisher or it can be self-propelled and/or mounted in a self-supporting manner above the finisher.

FIGS. 7 to 9 show an embodiment in connection with which a transfer device with an intermediate storage container 11 is mounted on the finisher. With the help of an intermediate-storage conveyor belt 12, the hot mixed material is transported from said intermediate storage container 11 via the supply containers 1, 2. A reversing flap 13 for alternately feeding the supply container 1 or the supply container 2 of the finisher is mounted above said supply container. The material receiving container 11 for temporarily storing the hot mixed material can be provided with a one-part or two-part chamber.

LIST OF REFERENCE NUMERALS

Material supply container for the base layer
Material supply container for the top layer
Conveyor belts for system 1
Conveyor device for system 2
Distributing screw for system 1
Distributing screw for system 2
Laying beam for base layer
Laying beam for top layer
Driver's cabin
Additional conveyor belt
Intermediate storage supply container
Intermediate storage conveyor belt
Reversing flap

What is claimed is:

1. An attachment to a road paver for placing and compacting pavement layers, the paver comprising an undercarriage with power unit, a first material hopper, a driver's cabin, a first auger for spreading, a first conveying system and a first compacting screed, the attachment including means, in conjunction with the paver, for placing two layers simultaneously hot on hot, said means comprising:

a second material hopper;

a second conveying system;

a second auger for spreading; and a second compacting screed;

said attachment being accommodated on a frame for fastening to the paver in a detachable manner and to be slipped from a side onto the paver's undercarriage, and provided with fastening points for detachably combining the attachment and the paver and the attachment and the driver's cabin, wherein the frame is equipped with adjustable girders that are movable via hydraulic rams, wherein the conveying systems or the material hoppers are fitted with heating devices, and wherein the frame is provided with pivot-mounted struts with caster wheels to make the attachment easily approach the paver from a side for combining.

2. An attachment according to claim 1, wherein both the material hoppers are located at the front of the paver.

3. An attachment according to claim 1, wherein the first compacting screed has a first control device and wherein the second compacting screed is fitted with a second control device for thickness set-up of a second of said two layers, which allows set-up of layer thickness by adjusting a screed planing angle, and wherein said second control device is linked with the first control device or operates as an independent control device.

4. An attachment according to claim 1, wherein on the upside of the paver, a movable conveyor is installed for feeding material into the second material hopper.

5. An attachment according to claim 1, wherein the attachment is linked with a transfer system for feeding the material hoppers in alternating mode, said transfer system being located at the front of the paver and featuring a two-compartment hopper for interim storage of hot mix, and wherein the attachment is equipped with an installation for automatic distance control which controls a distance between the paver and a transfer machine traveling in front of the paver.

* * * * *